US008276419B2

(12) United States Patent
Farrenkothen et al.

(10) Patent No.: US 8,276,419 B2
(45) Date of Patent: Oct. 2, 2012

(54) CYLINDER LOCK WITH PANEL TUMBLERS AND KEY FOR THE LOCK

(75) Inventors: Ralf Farrenkothen, Solingen (DE); Michael La Porte, Wuppertal (DE)

(73) Assignee: D. La Porte Sohne GmbH, Wuppertal (DE)

( * ) Notice: Subject to any disclaimer, the term of this patent is extended or adjusted under 35 U.S.C. 154(b) by 435 days.

(21) Appl. No.: 12/356,194

(22) Filed: Jan. 20, 2009

(65) Prior Publication Data

US 2009/0188286 A1 Jul. 30, 2009

(30) Foreign Application Priority Data

Jan. 22, 2008 (DE) ..... 20 2008 000 911 U

(51) Int. Cl.
*E05B 27/00* (2006.01)

(52) U.S. Cl. ..... 70/492; 70/409; 70/377

(58) Field of Classification Search ..... 70/377, 70/492, 401, 406, 407, 409
See application file for complete search history.

(56) References Cited

U.S. PATENT DOCUMENTS

| | | | | |
|---|---|---|---|---|
| 1,957,851 | A * | 5/1934 | Rubner | 70/340 |
| 2,123,940 | A * | 7/1938 | Gray | 70/492 |
| 2,623,959 | A | 12/1952 | Jarrett | |
| 2,647,391 | A * | 8/1953 | Uher | 70/492 |
| 2,766,611 | A * | 10/1956 | Hagel | 70/492 |
| 2,829,513 | A * | 4/1958 | Fresard et al. | 70/492 |
| 3,137,156 | A * | 6/1964 | Navarro | 70/492 |
| 3,956,912 | A * | 5/1976 | Broska | 70/360 |
| 3,969,915 | A * | 7/1976 | Droske | 70/492 |
| 4,357,815 | A * | 11/1982 | Kleefeldt et al. | 70/337 |
| 4,440,008 | A * | 4/1984 | Uher | 70/492 |
| 5,174,141 | A * | 12/1992 | Ohyabu | 70/492 |
| 5,265,455 | A * | 11/1993 | Grimmer | 70/492 |
| 5,438,856 | A * | 8/1995 | Richter et al. | 70/492 |
| 5,490,405 | A * | 2/1996 | Ramo et al. | 70/366 |
| 6,109,081 | A * | 8/2000 | Dimig et al. | 70/492 |
| 6,308,543 | B1 * | 10/2001 | Yoshizawa | 70/492 |
| 6,481,255 | B2 * | 11/2002 | Theriault et al. | 70/495 |
| 6,758,074 | B1 * | 7/2004 | Prunbauer | 70/366 |
| 7,159,424 | B2 * | 1/2007 | Widen | 70/409 |
| 7,240,525 | B2 * | 7/2007 | Sevillano Gil | 70/340 |
| 7,424,815 | B1 * | 9/2008 | Pagnoncelli | 70/340 |
| 7,484,392 | B2 * | 2/2009 | Katagiri | 70/492 |
| 7,690,232 | B2 * | 4/2010 | Klein et al. | 70/409 |
| 7,870,771 | B2 * | 1/2011 | Mueller et al. | 70/409 |
| 2006/0000251 | A1 * | 1/2006 | Ceron et al. | 70/492 |
| 2007/0006623 | A1 * | 1/2007 | Barrenberg et al. | 70/492 |

FOREIGN PATENT DOCUMENTS

| | | |
|---|---|---|
| DE | 72 03 658 | 2/1972 |
| DE | 76 37 619 | 1/1976 |
| DE | 27 42 165 C2 | 9/1977 |
| GB | 1101633 | 1/1968 |

* cited by examiner

*Primary Examiner* — Suzanne Barrett
(74) *Attorney, Agent, or Firm* — Brinks Hofer Gilson & Lione

(57) ABSTRACT

A cylinder lock is disclosed. The cylinder lock can be used on a motor vehicle door lock. The disclosed cylinder lock has plate tumblers and also a key for the cylinder lock. The key for the cylinder lock could be a reversible key.

22 Claims, 3 Drawing Sheets

CYLINDER LOCK WITH PANEL TUMBLERS AND KEY FOR THE LOCK

CROSS REFERENCE TO RELATED APPLICATION

This application claims priority to German Patent Application No. 20 2008 000 911.1, filed Jan. 22, 2008.

FIELD OF THE INVENTION

The invention relates to a cylinder lock with plate tumblers and to a key for the lock, which can be used in particular as a motor vehicle door lock.

BACKGROUND AND SUMMARY OF THE INVENTION

DE-U 72 03 658 discloses a cylinder lock which has a cylinder housing in which a cylinder core is rotatably mounted. The cylinder core has, in its central region, an axially extending key channel and guide slots which extend radially therethrough in a direction perpendicular to a longitudinal axis of the cylinder core. In each of the guide slots, two spring-loaded plate-shaped tumblers, so-called plate tumblers composed of sheet-metal punched parts, are seated therein so as to bear against one another in pairs, or axially adjacently, and so as to be alternately and radially movable. When the key is removed from the key channel, the plate tumblers radially engage in their blocking position (i.e., on account of the spring loading) into radially opposing blocking grooves which extend in the axial direction of the cylinder housing, such that the cylinder core is seated in a rotationally fixed manner in the cylinder.

The plate tumblers are of solid-frame-type design and have in each case two frame longitudinal webs and two frame transverse webs which form a substantially rectangular recess which is aligned axially with the key channel. Inwardly protruding control cams are arranged at inner edges of the frame longitudinal webs.

The appropriate flat key has a key bit or middle web which is substantially rectangular in cross section and which has two wide side surfaces and two narrow side surfaces. In each case, one groove-like recess is provided mirror-symmetrically oppositely on the wide side surfaces. The recesses extend in the longitudinal direction of the key bit and have groove walls which are aligned at right angles to the groove base, wherein the recesses are designed as control edges or control paths which interact with the correspondingly arranged control cams of the plate tumblers.

The paired arrangement makes it possible to use reversible keys which can be inserted into the key channel to actuate the closing mechanism by rotating the keys 180° about their longitudinal axis of the key bit. Here, the plate tumblers are pulled back into the interior space of the cylinder core counter to the respective spring force. On the basis of this known design, it is possible to use high quantities of different plate tumblers and thereby ensure high numbers of variations of locks. Furthermore, a shorter, more space-saving design of the closing cylinder is possible. On the other hand, a cylinder lock of said type still requires a relatively large cylinder core diameter of more than 15 mm, for example, as a result of which the spatial requirement in this respect still does not meet various needs and desires, such as those of the automobile industry.

Cylinder core diameters of less than 15 mm are possible using cylinder locks with plate tumblers which have closing cams on the inner edges of the frame transverse webs, with the control paths being formed on the narrow side surfaces of the key bit (DE-U 76 37 619). A disadvantage of such an arrangement, however, is the possibility of simple reproduction and a weakening of the key bit by means of excessively deep milled portions of the control paths, for which reason said cylinder lock type with plate tumblers is no longer common in motor vehicle doors despite its small design.

A further cylinder lock type with plate tumblers and with a particularly high level of variation diversity of the control edges and particularly high strength of the flat key is known for example from DE 27 42 165 C2. The cylinder core of the closing cylinder has plate tumblers which are alternately spring-loaded towards one another and the flat key is provided with oppositely-aligned, stepped incision paths or control paths which are open to opposite narrow sides of the flat profile and which are separated from one another by a continuous key bit or middle web of the flat profile. In said known cylinder lock type, the flat key has a Z-shaped basic profile with the middle web, and two incision paths or control paths are arranged on the inner surfaces, wherein each faces towards the opposite narrow side of the flat profile of the two Z-limbs. To be able to operate said cylinder lock type with a reversible key which facilitates use, the control paths are formed so as to be mirror-symmetrically identical to one another, though this restricts the variation diversity. Furthermore, when using the reversible key version, it is not easily possible to ensure a closing cylinder diameter of less than 15 mm.

It is an object of the invention to increase the variation diversity of a cylinder lock type known from DE 27 42 165 C2 and the like, while simultaneously permitting the use of a reversible key for this purpose. Furthermore, it is also an object to produce a closing cylinder having a diameter of less than 15 mm, yet capable of accommodating up to 8 plate tumblers, for example.

Additional benefits and advantages of the present invention will become apparent to those skilled in the art to which the present invention relates from the subsequent description of the preferred embodiment and the appended claims, taken in conjunction with the accompanying drawings.

BRIEF DESCRIPTION OF THE DRAWINGS

The invention is explained in more detail below by way of example on the basis of the drawings, in which.

DETAILED DESCRIPTION OF THE INVENTION

Figure 1:
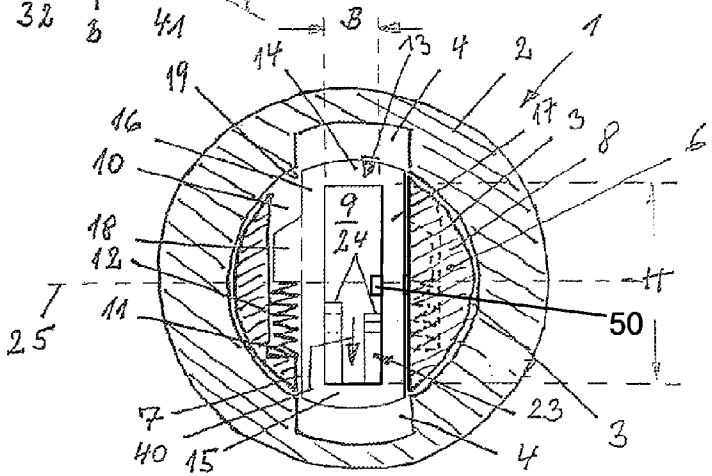
FIG. 1 shows a cross section through a cylinder lock according to the invention with 6 plate tumblers.

As shown in FIG. 1, a cylinder lock according to the invention has a cylinder housing 1 with a cylinder wall 2 which may be of any desired external design and which may be composed of various materials known in the art, such as, but not limited to metals, plastics, and the like. The cylinder wall 2 surrounds an axial cylindrical lock core recess 3. In addition, the cylinder wall 2 includes at least one blocking groove 4 therein. The blocking groove 4 extends axially parallel in the cylinder wall 2 and is open in the direction of the recess 3. If two blocking grooves 4 are provided, said blocking grooves 4 are arranged diametrically oppositely, as shown in FIG. 1.

Figure 2:
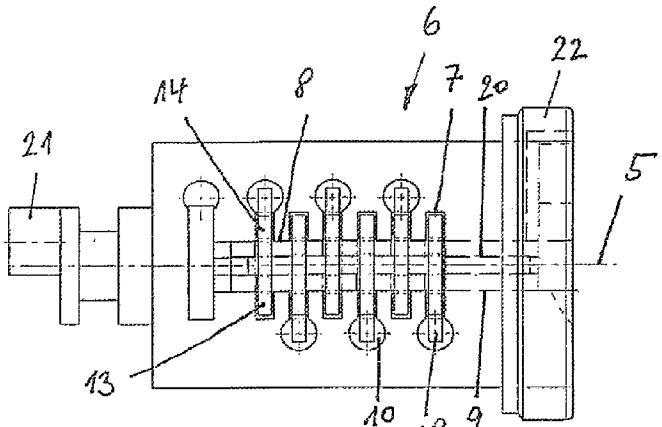
FIG. 2 shows a plan view of the cylinder core of the cylinder lock according to FIG. 1.

A cylinder core 6 is arranged in the cylindrical lock core recess 3 of the cylinder housing 1 so as to be rotatable to a limited extent about the central longitudinal axis 5 of said cylindrical lock core recess 3. As best shown in FIGS. 1 and 2, the cylinder core 6 is provided with an axial key channel 9. In the region of the axial key channel 9, the cylinder core includes a plurality of continuous chamber slots 7 aligned transversely with respect to the longitudinal axis 5. While there are six chamber slots 7 depicted in FIG. 2, it should be understood to those of ordinary skill in the art that more or less chamber slots 7 may be provided. The chamber slots 7 are separately spaced from one another by wall webs 8, so as to be axially aligned with one another. Each chamber slot 7 has, on one side, a widened portion such as a blind hole 10, for example, with a bearing step 11 on which a pressure spring 12 is mounted.

A substantially rectangular-frame-shaped plate tumbler 13 is slidably seated in each chamber slot 7, wherein the plate tumbler 13 is composed, for example, of a sheet-metal punched part having two transverse frame webs 14, 15 and two longitudinal frame webs 16, 17. The two transverse frame webs 14, 15 and two longitudinal frame webs 16, 17 collectively form a substantially rectangular interior space having a height "h" and a width "b", such that the interior space surrounds the key channel 9. On the outside of the longitudinal frame web 16 which faces towards the blind hole 10, an abutment lug 18, which projects into the sheet-metal plane, is arranged above the bearing step 11 such that the pressure spring 12 presses against the abutment lug, wherein the abutment lug 18 can be supported against the inner wall 19 of the cylinder wall 2 of the cylinder housing 1.

An assembly slot 20 is expediently situated, above the key channel 9 on the side at which the blind hole 10 opens, in the wall of the cylinder core 6. The assembly slot 20 extends parallel to the longitudinal axis 5 up to the key channel 9 and through the wall webs 8. The assembly slot 20 facilitates the assembly of the plate tumblers 13 and of the pressure springs 12.

At one end, the cylinder core 6 has—as is conventional—a driver 21 for a lock mechanism (not illustrated) and, at the other end, a collar 22 which serves in particular as a stop on the cylinder housing 1.

Each rectangular interior space of the frame of the plate tumblers 13, which rectangular interior space is aligned with the key channel 9, has a control step 24. The control step may either be provided on a side beyond the bisecting line of the height "h", or on one side of a central longitudinal plane 25 (e.g., below the longitudinal plane 25 in FIG. 1) which encompasses the longitudinal axis 5 and which lies at right angles or perpendicular to the frame longitudinal webs 16, 17. The control step 24 projects into the interior space of the frame in a corner region 23 situated diagonally opposite the abutment lug 18 between a transverse frame web 14 or 15 and a longitudinal frame web 16 or 17, with the control step 24 extending at right angles to the inner edge of the longitudinal frame web 16 or 17.

In the case of plate tumblers 13 which are adjacent in the direction of the longitudinal axis 5, the control step 24 for one plate tumbler may be situated on one longitudinal frame web 17 and, for the following plate tumbler, on the other longitudinal frame web 16 in the laterally opposite corner region 23 on the same side of the plane 25. FIG. 1 shows said configuration with six plate tumblers 13 which are seated one behind the other in the axial direction of the longitudinal axis 5, with three control steps 24 of three plate tumblers 13 being provided on the one side (the left-hand side in FIG. 1), and likewise, three control steps 24 of three further plate tumblers 13 being provided on the opposite side (the right-hand side in FIG. 1), by means of stepped punched portions, with the control steps 24 being arranged at different heights as measured from the inner edge of a transverse frame web 14 or 15. Nevertheless, it is to be understood by those of ordinary skill in the art that the present invention is not so limited, as it falls within the scope of the invention for control steps 24 to also be arranged on cams which project into the interior space of the frames.

The blind holes 10 of adjacent chamber slots 7, and therefore also the abutment lugs 18 of adjacent plate tumblers 13, are expediently arranged diagonally oppositely, as a result of which the chamber slots 7 can be arranged closer together and the cylinder core 6 can be of short design.

Figure 3:
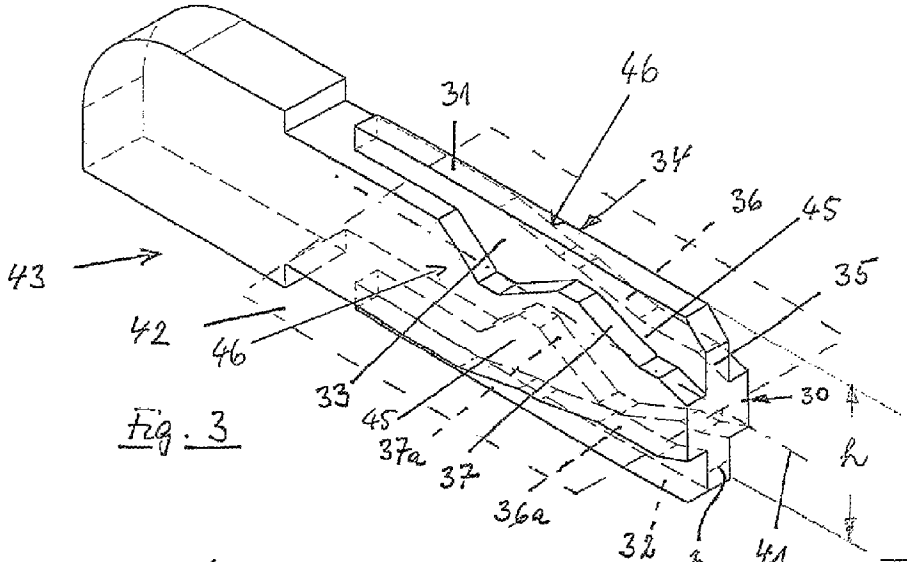
FIG. 3 shows a perspective view of a flat key for the cylinder lock according to FIG. 1.

On account of the design of the cylinder core 6, each plate tumbler contains one control step 24, wherein the control steps 24 are arranged laterally at both sides in the key channel 25, yet only at one side with respect to the plane 25, with a spacing to the plane 25 of the frames of the plate tumblers 13 and so as to slide in the same direction during the actuation with a key (arrow 40 in FIG. 1), it is possible to design a reversible key 43 having a central, continuous middle web or key bit 30. As best shown in FIG. 3, the key bit 30 is rectangular in cross section and has a central longitudinal central axis 41, a height "h" and a width "b", two narrow edges 31, 32. two wide side surfaces 33, 34, and an end edge 35.

On one side of a longitudinal plane 42 which extends perpendicular or at right angles to the wide side surfaces 33, 34 and which encompasses the longitudinal central axis 41 of the middle web 30 or the middle of the height "h", a control path 37 which projects from said longitudinal plane 42 at right angles and extends in the longitudinal direction of the middle web 30 is formed on the wide side surface 33 with a spacing to the longitudinal plane 42, and a control path 36 which projects from said control plane 42 at right angles and extends in the longitudinal direction of the middle web 30 is formed on the wide side surface 34 with a spacing to the longitudinal plane 42. The control paths 37, 36 may be generated for example by an abutting milled portion and are situated on the one side of the longitudinal plane 42 with a spacing to the latter.

On the other side of the longitudinal plane 42, a control path **36*a* which projects from said longitudinal plane 42 at right angles and extends in the longitudinal direction of the middle web 30 is arranged on the wide side surface 33 with a spacing to the longitudinal plane 42, and a control path 37*a* which projects from said longitudinal plane 42 at right angles and extends in the longitudinal direction of the middle web 30 is arranged on the wide side surface 34 with a spacing to the longitudinal plane 42**.

The contours of the control paths 36 and 37 differ from one another, and the contours of the control paths **36*a* and 37*a* also differ from one another, but the contours of the control paths 36*a* and 36 and the contours of the control paths 37*a* and 37** are identical.

The control paths 36 and 37 are situated on one side of the longitudinal plane 42, and the control paths **36*a* and 37*a* are situated on the other side of the longitudinal plane 42, wherein the control paths 36, 36***a* and 37, 37*a* have the same spacing to the longitudinal plane 42. The control paths 36, 36*a* and the control paths 37, 37*a* are therefore situated mirror-symmetrically diagonally opposite one another with respect to a mirror plane which passes through the longitudinal central axis 41 of the middle web 30.

Accordingly, the key 43, as a reversible key, provides identical control paths 36, 37 or 36*a*, 37*a* to the control steps 24 of the plate tumblers 13 after having been rotated through 180° about its longitudinal axis 41.

The control paths 36, 36*a*, 37, 37*a* are adapted, in a manner known per se, to the control steps 24 of the plate tumblers 13 in such a way that, as the key 43 is inserted into the key channel 9, the plate tumblers 13 are pulled out of a blocking groove 4 into the interior of the cylinder core 6. Said position of the plate tumblers 13 is shown in FIG. 1. The cylinder core 6 can thereafter be rotated about its longitudinal axis 5. If the key 43 is pulled out, the springs 12 force a portion of the plate tumblers 13 into a blocking groove 4, such that the cylinder core 6 is locked in the cylinder housing 1. According to the invention, only one blocking groove 4 is required. Yet a second blocking groove may be provided to facilitate assembly by making it possible for the cylinder core 6 to be pushed into the cylinder housing 1 during assembly even after having been rotated 180° about its longitudinal axis 5.

Figure 4:
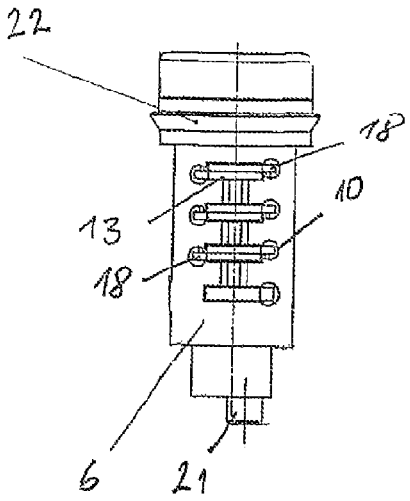
FIG. 4 shows a plan view of a cylinder core of a further embodiment of the invention.
Figure 5:
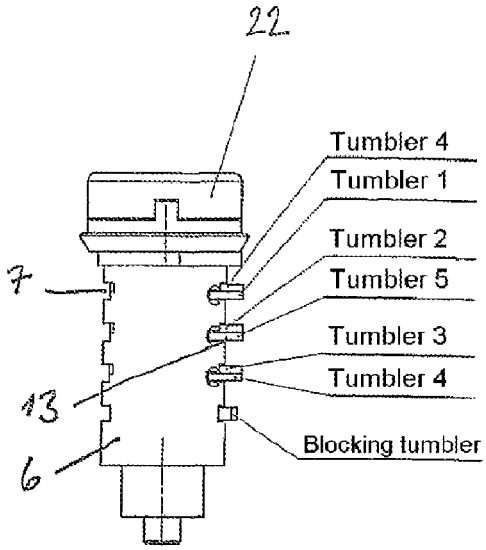
FIG. 5 shows a side view of the cylinder core according to FIG. 4.

Referring now to FIGS. 4 and 5, an alternative embodiment of the invention provides a paired arrangement of plate cylinder tumblers 13, with two plate tumblers 13 being arranged in one chamber slot 7, such that the structural length of the cylinder core 6 can be kept very short. By way of example, FIG. 5 shows the distribution of the plate tumblers 13. The plate tumblers 13 correspond to the design shown in FIG. 1 and the design of the cylinder housing 6 corresponds to the design likewise shown in FIG. 1.

Figure 6:
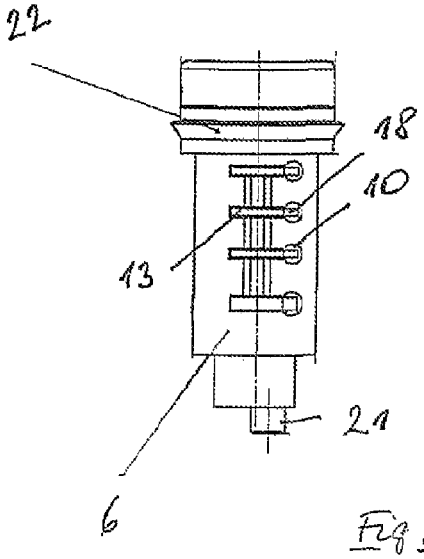
FIG. 6 shows a plan view of another embodiment of a cylinder core for a cylinder lock according to the invention.
Figure 7:
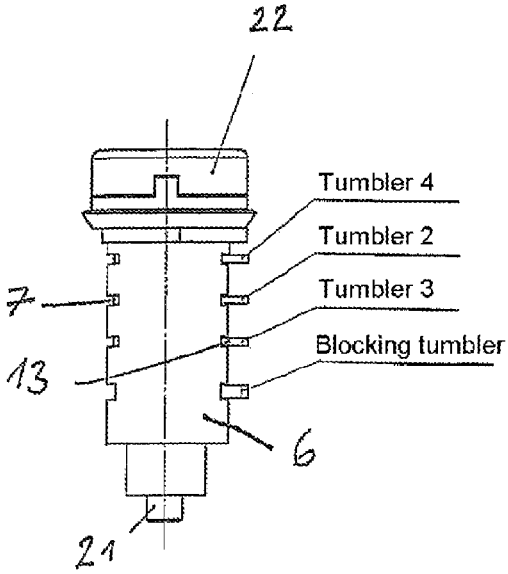
FIG. 7 shows a side view of the cylinder core according to FIG. 6.

The invention provides the use of at least three plate tumblers 13 and the corresponding configuration of the cylinder core 6 can be seen in FIGS. 6 and 7. As shown in the Figures, the blind holes 10 may be arranged on the same narrow side of the chamber slots 7. The greater the number of plate tumblers 13, the more expedient it is for the blind holes 10 of adjacent chamber slots 7 to be arranged diagonally oppositely, as shown in FIG. 2.

The invention permits for example up to eight plate tumblers 13 without it being necessary for the diameter of the cylinder core 6 to exceed 15 mm.

Figure 8:
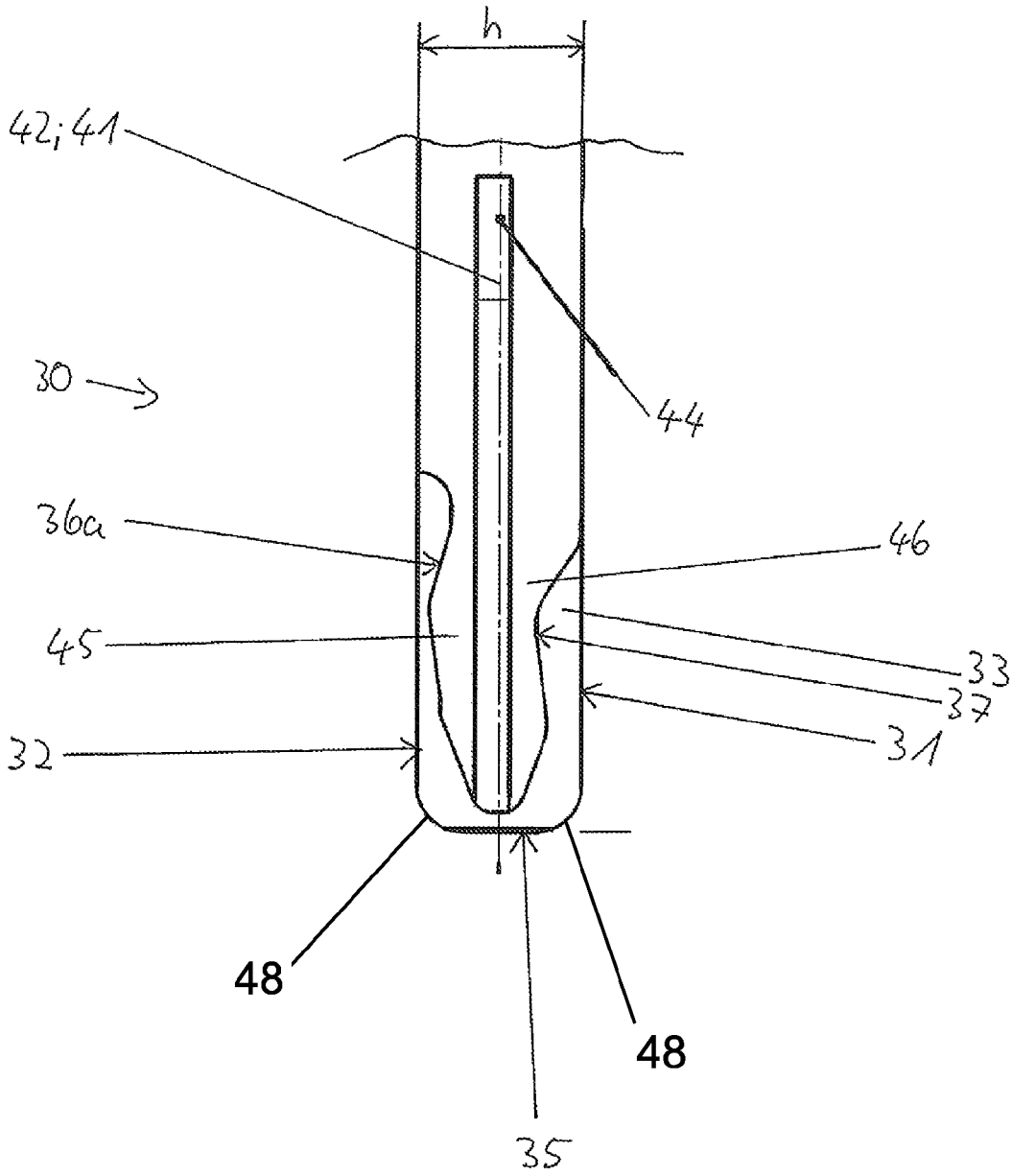
FIG. 8 shows a view of the wide side of a key bit according to yet another embodiment of the key according to the invention.

Referring now to FIG. 8, a further advantageous embodiment of the invention is shown wherein the reversible key 43 also has two longitudinal or centering grooves 44 which each extend parallel to the longitudinal central axis 41. Here, one centering groove 44 is provided on each side of the key 43 in relation to the wide side surfaces 33, 34, with the centering grooves 44 being arranged in each case between the two control paths 37, 36*a* and 36, 37*a* which, respectively, are situated on the same side of the key 43 in relation to the wide side surfaces 33, 34. Here, each of the centering grooves 44 expediently extend, proceeding from the end edge 35, into the reversible key 43 as viewed perpendicular to the wide side surfaces 33, 34, such that said centering grooves 44 are open in the direction of the end edge 35. In particular, between two control paths 37, 36*a* and 36, 37*a* which, respectively, are situated on the same side of the key 43 in relation to the wide side surfaces 33, 34, a wall 45 is provided in each case which connects the control paths 37, 36*a* and 36, 37*a*, respectively, and which adjoins the wide side surfaces 33, 34. The walls 45 each have one wall side surface 46 which is parallel to the wide side surfaces 33, 34 and into which the centering grooves 44 are formed.

The centering grooves 44 are also preferably arranged and formed centrally (not illustrated) or slightly eccentrically (FIG. 8) in relation to the height "h".

The centering grooves 44 serve to guide and centre the key 43 in the cylinder core 6. For this purpose, the cylinder core 6 has at least one centering pin 50 which projects into the key channel 9, wherein the centering pin 50 is guided in a sliding fashion in a centering groove 44, and thereby guides and centers the key 43, as the key 43 is inserted.

Furthermore, according to one aspect of the embodiment depicted in FIG. 8, the control paths 36, 36*a*, 37 and 37*a* and therefore the walls 45 end with a certain spacing before the end edge 35, such that the latter protrudes slightly beyond the control paths 36, 36*a*, 37 and 37*a* and the walls 45 in the direction of the longitudinal central axis. The free end edge 35 forms a key stop which delimits the insertion travel of the key 43 into the cylinder lock.

Furthermore, the end edge 35 and the narrow edges 31, 32 preferably merge into one another via rounded edges 48.

As a person skilled in the art will readily appreciate, the above description is meant as an illustration of the principles of this invention. This description is not intended to limit the scope or application of this invention in that the invention is susceptible to modification, variation and change, without departing from spirit of this invention, as defined in the following claims.

The invention claimed is:

1. A cylinder lock comprising:

a cylinder housing having a cylinder wall surrounding an axial cylindrical core recess including at least one blocking groove formed therein, the at least one blocking groove extending axially parallel with respect to the cylindrical core recess and opening in a direction thereto;

a cylinder core seated within the cylindrical core recess and rotatable about a central longitudinal axis thereof, the cylinder core having an axial key channel and a plurality of chamber slots serially extending behind one another along the longitudinal axis and aligned transversely thereto, wherein the plurality of chamber slots proceed from the axial key channel, a plurality of wall webs for separating the plurality of chamber slots;

a plurality of rectangular frame-shaped plate tumblers slidably seated in the plurality of chamber slots and being spring-loaded so as to slide in one common sliding direction, the sliding direction being perpendicular to the longitudinal axis, the plurality of plate tumblers having at least one transverse frame web and two lateral longitudinal frame webs which are configured to form a generally rectangular interior space surrounding the key channel;

at least one stationary centering pin projecting into the key channel in a direction perpendicular to the sliding direction and perpendicular to the longitudinal axis and configured to guide and center the flat key as the flat key is inserted into the key channel;

wherein the plurality of plate tumblers have a plurality of control steps projecting into the interior space and laterally disposed at both sides in the key channel, each one of the plurality of control steps proceeding from one of the two longitudinal frame webs respectively and extending at right angles thereto; the plurality of control steps being disposed on only one side of a central longitudinal plane encompassing the longitudinal axis, the longitudinal plane lying perpendicular to the longitudinal frame webs and perpendicular to the sliding direction; and wherein at least one control step corresponding to a plate tumbler of the plurality of plate tumblers is differently spaced from the longitudinal plane than the control steps corresponding to the other plate tumblers of the plurality of plate tumblers.

2. The cylinder lock according to claim 1, wherein the plurality of chamber slots comprise at least three chamber slots.

3. The cylinder lock according to claim 1, wherein the plurality of control steps are formed by a stepped-punched portion in corner regions between the at least one transverse frame web and one of the two longitudinal frame webs.

4. The cylinder lock according to claim 1, wherein the plurality of plate tumblers are arranged in pairs so as to slide in an identical direction within the plurality of chamber slots.

5. The cylinder lock according to claim 4, wherein a blind hole is provided at a narrow side of each chamber slot of the plurality of chamber slots, and wherein the plurality of plate tumblers each comprise an abutment lug, the abutment lug being located on an outside surface of one of the two longitudinal frame webs.

6. The cylinder lock according to claim 5, further comprising a pressure spring having a first end and a second end, the first end bearing against a base of the blind hole, the second end being supported by one side of the abutment lug, wherein another side of the abutment lug is supported by an inner wall of the cylinder wall.

7. The cylinder lock according to claim 1, wherein the cylinder core has a diameter less than or equal to 15 mm.

8. The cylinder lock according to claim 1, comprising a reversible flat key, the flat key comprising:

a central middle web of rectangular cross-section having two narrow edges, two wide side surfaces, an end edge, and a central longitudinal axis; and a first pair of control paths and a second pair of control paths, each pair of control paths having a first control path and a second control path, the first pair of control paths and the second pair of control paths being arranged on opposite sides of a longitudinal plane, wherein the first control path and the second control path of a pair of control paths are formed on opposite wide side surfaces, respectively, wherein the first pair of control paths and the second pair of control paths are adaptable to respective control steps of the plurality of plate tumblers-such that the plurality of plate tumblers are pulled out of the at least one blocking groove as the flat key is inserted into the key channel.

9. The cylinder lock according to claim 8, wherein the longitudinal plane extends perpendicularly to the two wide surfaces and encompasses the longitudinal axis of the cylindrical core recess.

10. The cylinder lock according to claim 9, wherein a first control path of the first pair of control paths is formed on the first wide side surface of the two wide side surfaces and a second control path of the first pair of control paths is formed on the second wide side surface of the two wide side surfaces, and wherein the first and second control paths of the first pair of control paths project from the wide side surfaces at right angles, respectively, and extend along the longitudinal axis of the middle web, respectively.

11. The cylinder lock according to claim 10, wherein a first control path of the second pair of control paths is arranged on the first wide side surface of the two wide side surfaces and a second control path of the second pair of control paths is arranged on the second wide side surface of the two wide side surfaces, and wherein the first and second control paths of the second pair of control paths project from the wide side surfaces at right angles, respectively, and extend along the longitudinal axis of the middle web, respectively.

12. The cylinder lock according to claim 11, wherein the first control path and the second control path of the first pair of control paths are respectively formed on the first wide side surface and the second wide side surface of the two wide side surfaces with a spacing to the longitudinal plane, and wherein the first control path and the second control path of the second pair of control paths are respectively arranged on the first wide side surface and the second wide side surface of the two wide side surfaces with a spacing to the longitudinal plane.

13. The cylinder lock according to claim 12, wherein the first control path of the first pair of control paths has a different contour than a contour corresponding to the second control path of the first pair of control paths, and wherein the first control path of the second pair of control paths has a different contour than a contour corresponding to the second control path of the second pair of control paths.

14. The reversible flat key cylinder lock according to claim 13, wherein the contour corresponding to the first control path of the first pair of control paths is identical to the contour corresponding to the first control path of the second pair of control paths, and wherein the contour corresponding to the second control path of the first pair of control paths is identical to the contour corresponding to the second control path of the second pair of control paths.

15. The cylinder lock according to claim 14, wherein the first control paths of the first and second pairs of control paths and the second control paths of the first and second pairs of control paths are situated mirror-symmetrically opposite one another with respect to a mirror plane, the mirror plane encompassing the longitudinal axis of the middle web.

16. The cylinder lock according to claim 15, further comprising:

two centering grooves extending parallel to the longitudinal axis of the middle web, wherein a first centering groove of the two centering grooves is provided on a first side of the flat key, and a second centering groove of the two centering grooves is provided on a second side of the flat key;

wherein the cylinder core comprises at least one centering pin for guiding and centering the flat key as the flat key is inserted into the key channel, the at least one centering pin projecting into the key channel and configured to slidably guide in at least one of the two centering grooves.

17. The cylinder lock according to claim 16, wherein the first centering groove is arranged between the first control paths of the first pair of control paths and the second control path of the second pair of control paths, and wherein the second centering groove is arranged between the first control path of the second pair of control paths and the second control path of the first pair of control paths.

18. The cylinder lock according to claim 17, wherein the first and second centering grooves proceed from the end edge and are open in a direction thereto.

19. The cylinder lock according to claim 18, further comprising:

a first wall disposed on the first side of the flat key, the first wall having a first wall side surface in parallel to the first wide side surface;

a second wall disposed on the second side of the flay key, the second wall having a second wall side surface in parallel to the second wide side surface;

wherein the first centering groove is formed on the first wall side surface and the second centering groove is formed on the second wall side surface.

20. The cylinder lock according to claim 2, wherein each control step of the plurality of plate tumblers is differently spaced from the longitudinal plane.

21. The cylinder lock according to claim 8, wherein the control paths for the first pair of control paths and the control paths for the second pair of control paths are formed by abutting milled portions.

22. The cylinder lock according to claim 1, further comprising a reversible flat key, the flat key comprising:

a central middle web of rectangular cross-section having two narrow edges, two wide side surfaces, an end edge, and a central longitudinal axis;

a first pair of control paths and a second pair of control paths, each pair of control paths having a first control path and a second control path, the first pair of control paths and the second pair of control paths being arranged on opposite sides of a longitudinal plane, wherein the first control path and the second control path of a pair of control paths are formed on opposite wide side surfaces, respectively, wherein the first pair of control paths and the second pair of control paths are adaptable to respective control steps of the plurality of plate tumblers-such that the plurality of plate tumblers are pulled out of the at least one blocking groove as the flat key is inserted into the key channel; and two straight centering grooves extending parallel to the longitudinal axis of the middle web, wherein one of the two centering grooves is provided on each of the two wide side surfaces of the flat key, and a second centering groove of the two centering grooves is provided on a second side of the flat key, wherein the at least one centering pin is configured to slidably glide in at least one of the two centering grooves.

* * * * *

UNITED STATES PATENT AND TRADEMARK OFFICE

CERTIFICATE OF CORRECTION

PATENT NO. : 8,276,419 B2
APPLICATION NO. : 12/356194
DATED : October 2, 2012
INVENTOR(S) : Farrenkothen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 552 days.

Signed and Sealed this
Nineteenth Day of August, 2014

Michelle K. Lee

Michelle K. Lee
*Deputy Director of the United States Patent and Trademark Office*